United States Patent [19]

Marchant

[11] Patent Number: 4,735,364

[45] Date of Patent: Apr. 5, 1988

[54] ELECTROSTATIC SPRAY HEAD

[75] Inventor: John A. Marchant, Bedford, England

[73] Assignee: National Research Development Corporation, London, England

[21] Appl. No.: 902,082

[22] Filed: Aug. 27, 1986

Related U.S. Application Data

[63] Continuation of Ser. No. 566,814, Dec. 29, 1983, abandoned.

[30] Foreign Application Priority Data

Jan. 6, 1983 [GB] United Kingdom ..... 8300261
Jun. 3, 1983 [GB] United Kingdom ..... 8315309

[51] Int. Cl.[4] ..... B05B 5/02

[52] U.S. Cl. ..... 239/690.1; 239/691; 239/708

[58] Field of Search ..... 239/690–708, 239/3, 103, 120–122

[56] References Cited

U.S. PATENT DOCUMENTS

| | | | |
|---|---|---|---|
| 1,828,463 | 10/1931 | Hammers | 239/103 |
| 2,784,351 | 3/1957 | Renner | 239/703 X |
| 2,901,177 | 8/1959 | Norris | 239/703 |
| 2,989,241 | 6/1961 | Badger | 239/703 |
| 3,010,428 | 11/1961 | Sedlacsik | 239/703 X |
| 3,086,712 | 4/1963 | Frazier | 239/224 X |
| 3,121,533 | 2/1964 | Sedlacsik, Jr. | 239/703 |
| 3,221,992 | 12/1965 | Sedlacsik, Jr. et al. | 239/703 |
| 3,281,860 | 10/1966 | Adams et al. | 239/102 X |
| 3,285,516 | 11/1966 | Waldrum | 239/102 X |
| 3,613,993 | 10/1971 | Gourdine | 239/707 X |
| 3,679,132 | 7/1972 | Vehe et al. | 239/4 |
| 3,698,635 | 10/1972 | Sickles | 239/3 |
| 4,004,733 | 1/1977 | Law | 239/3 |
| 4,009,829 | 3/1977 | Sickles | 239/705 |
| 4,043,507 | 8/1977 | Wace | 239/4 X |
| 4,148,932 | 4/1979 | Tada et al. . | |
| 4,186,886 | 2/1980 | Sickles | 239/705 X |
| 4,198,781 | 4/1980 | Dykes | 239/3 X |
| 4,215,818 | 8/1980 | Hopkinson | 239/3 |
| 4,240,585 | 12/1980 | Sickles | 239/705 |
| 4,258,409 | 3/1981 | Porter | 239/706 X |
| 4,275,838 | 6/1981 | Fangmeyer | 239/703 X |
| 4,275,846 | 6/1981 | Coffee | 239/690 |
| 4,356,528 | 10/1982 | Coffee | 239/690 |
| 4,362,275 | 12/1982 | Coffee . | |

FOREIGN PATENT DOCUMENTS

| | | | |
|---|---|---|---|
| 248444 | 12/1963 | Australia . | |
| 233700 | 10/1962 | Austria | 239/693 |
| 608728 | 1/1979 | Fed. Rep. of Germany | 239/693 |
| 2839013 | 3/1979 | Fed. Rep. of Germany | 239/223 |
| 665655 | 1/1952 | United Kingdom . | |
| 885597 | 12/1961 | United Kingdom . | |
| 887450 | 1/1962 | United Kingdom . | |
| 891342 | 3/1962 | United Kingdom . | |
| 917683 | 2/1963 | United Kingdom . | |
| 923392 | 4/1963 | United Kingdom . | |
| 1012129 | 12/1965 | United Kingdom . | |
| 1037936 | 8/1966 | United Kingdom . | |
| 1107060 | 3/1968 | United Kingdom . | |
| 1202117 | 8/1970 | United Kingdom . | |
| 1268391 | 3/1972 | United Kingdom . | |
| 1303625 | 1/1973 | United Kingdom . | |
| 1307878 | 2/1973 | United Kingdom . | |
| 1311464 | 3/1973 | United Kingdom . | |
| 1326173 | 8/1973 | United Kingdom . | |
| 1335071 | 10/1973 | United Kingdom . | |
| 1435181 | 5/1976 | United Kingdom . | |
| 1538931 | 1/1979 | United Kingdom . | |
| 1587952 | 4/1981 | United Kingdom . | |
| 2093734 | 9/1982 | United Kingdom | 239/707 |

OTHER PUBLICATIONS

A. J. Arnold & B. J. Pye, Spray Application with Charged Rotary Atomisers, British Corp. Protection Council, 7, 30, 1981 pp. 109–117, Monograph 24, May 1980.

*Primary Examiner*—Andres Kashnikow
*Assistant Examiner*—Michael J. Forman
*Attorney, Agent, or Firm*—Cushman, Darby & Cushman

[57] ABSTRACT

A spray head for a spray nozzle including a hood providing a surface extending forward from the nozzle and also supporting insulating mountings for electrodes energizable to exert an inductive charging field or spray from the nozzle. The surface is earthed or earthy in operation to encourage collection of stray or return spray and stop stray or return spray affecting the charging field by landing on the electrodes or their mountings. The collected spray may be retained as liquid or caused to flow to projections to again leave the spray head as small droplets. The field from the electrodes may shape the spray.

12 Claims, 5 Drawing Sheets

ELECTROSTATIC SPRAY HEAD

Figure 1:
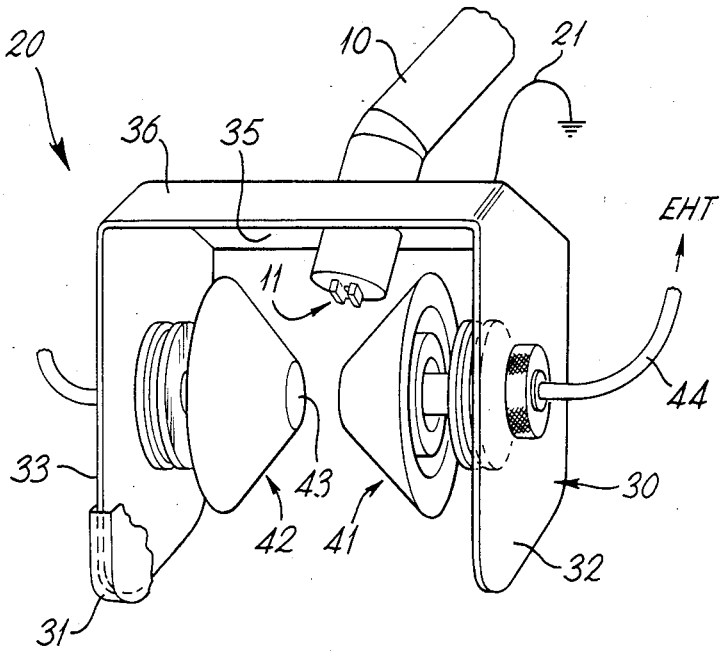
Figure 1A:
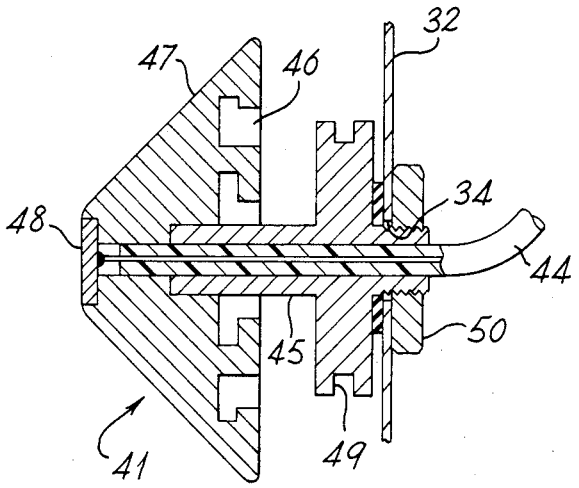

This is a continuation of application Ser. No. 566,814, filed Dec. 29, 1983, which was abandoned upon the filing hereof.

This invention relates to the production and application of small particles of electrically charged material. The material may be an agricultural chemical such as pesticide, herbicide, fungicide or even fertiliser for growing plants or seeds and the particles may be droplets with diameters in the order of a few micrometers to a hundred or more micrometers charged by electrostatic techniques. The material is usually dissolved or dispersed in a liquid.

The requirements of safety and economy now existing or being proposed for the use of agricultural chemicals mean that spraying of such chemicals must be more precise so that the predicted, and required, results are achieved.

It is an object of the invention to provide an improved spray head apparatus and method of applying charged spray using such a head.

According to the invention there is provided a spray head for a spray nozzle including a hood providing a surface to extend forward from the nozzle, the hood also providing support for an insulating mounting for an electrode arrangement energisable in operation to exert a charging field forward of the nozzle for inductive charging action on liquid sprayed from the nozzle, the hood impeding the return of charged and uncharged liquid spray to the electrode arrangement and any mounting therefor.

The hood may be of conductive material or have a conductive surface if the sprayed liquid is not conductive. The nozzle or support may be earthed via a conductive liquid to be sprayed or separately if the liquid is not conductive.

The insulating electrode mounting may be convoluted to obstruct the formation of a liquid path to earth from the electrode.

The spray head may be readily attached to and released from a spray nozzle or support lance therefor.

The spray head may include means to retain return spray deposited thereon and collect this deposit.

The spray head produces improved spraying methods requiring less chemical and diluent with predictable application rates.

The electrode arrangement may be opposed electrodes forward of the nozzle.

The electrode arrangement may be chosen to alter the shape of the spray fan from the nozzle.

According to a particular aspect of the invention there is provided a spray head as described above having at least one elongate projection and a liquid flow control means to direct liquid on the spray head to the elongate projection for flow along said projection, whereby in operation with an electric field at the spray head liquid leaves said projection as small droplets.

The elongate projection may be part of the hood. The elongate projection may be attached to or part of an electrode mounting. The projections may be integral with or attached to the hood or electrode mounting. The or each projection may have one or more sharp points.

The projections may be of insulating material when a conductive liquid is used.

The hood may have more than one projection. The hood projection or projections may extend towards the path of liquid sprayed from the nozzle to approach a space charge field region.

Figure 2:
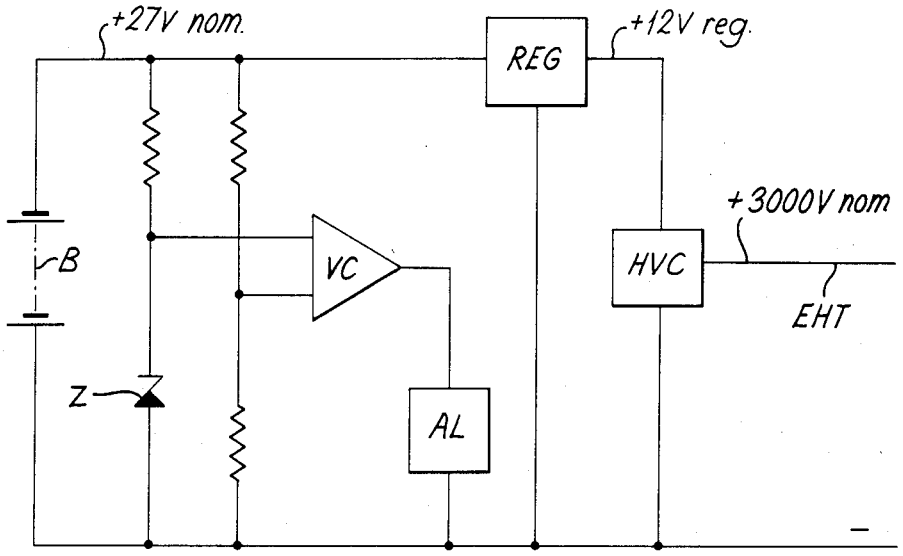
Figure 3:
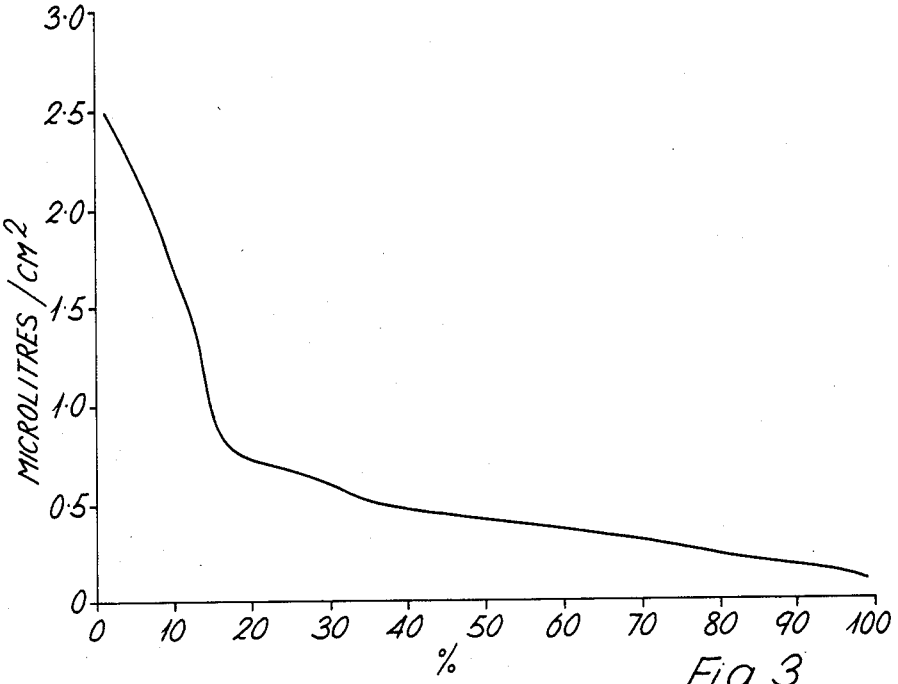
Figure 4:
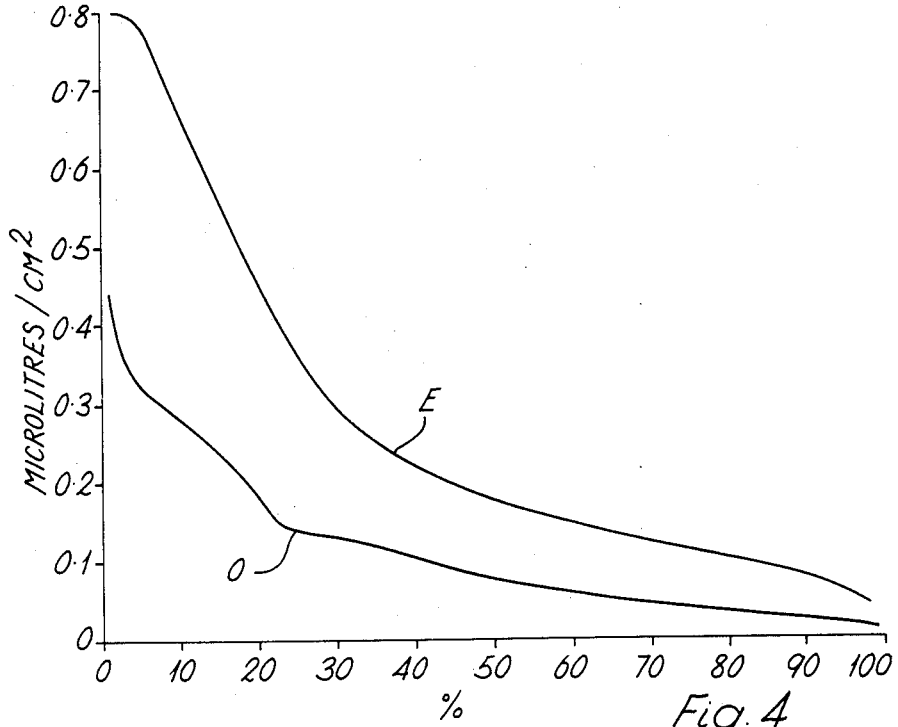

Embodiments of the invention will now be described with reference to the accompanying drawings in which FIG. 1 is a view of a spray head according to the invention, FIG. 2 is a circuit, in block form, of a power supply for a spray head such as that of FIG. 1, FIG. 3 is a graph showing the performance of a known spray nozzle, FIG. 4 is a graph showing the performance of a spray head according to the invention.

Figure 5:
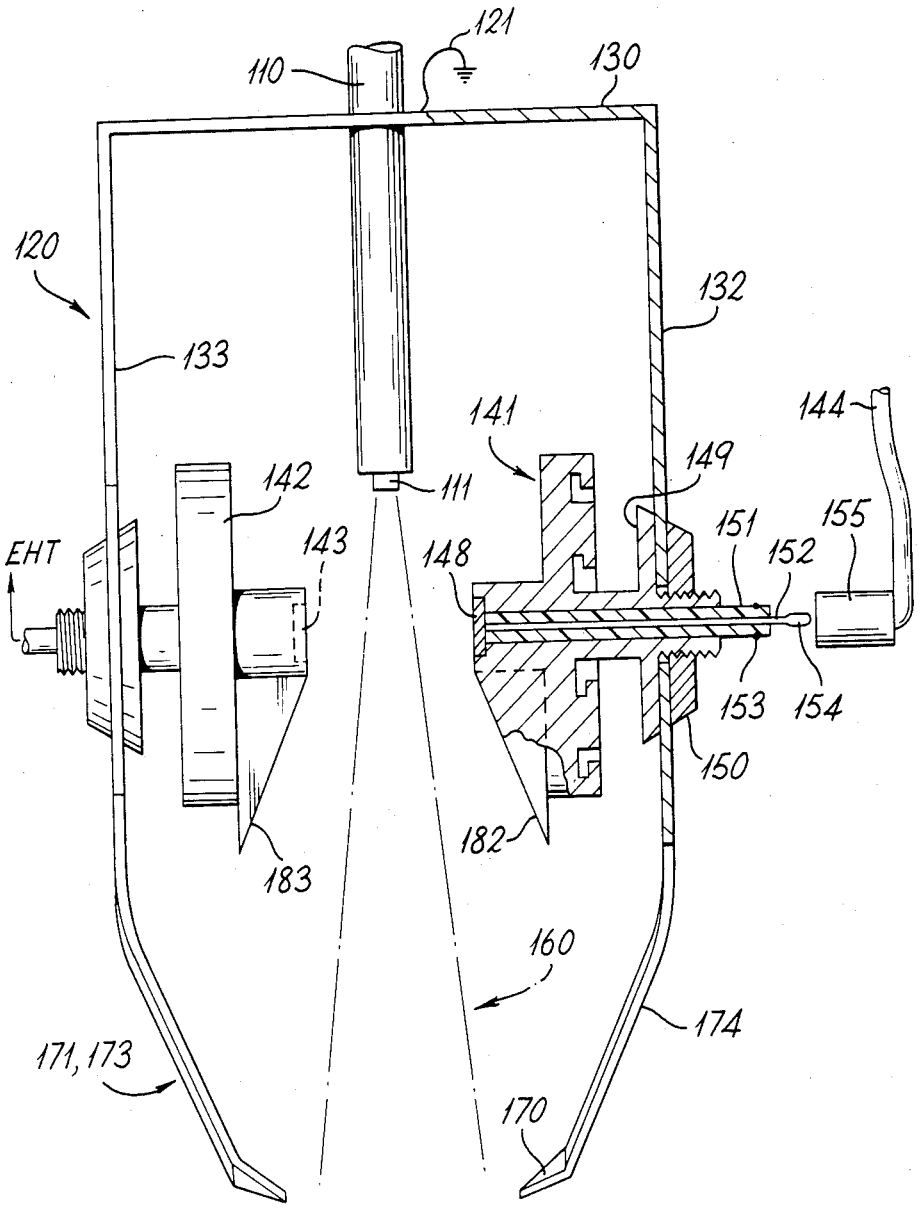
Figure 6:
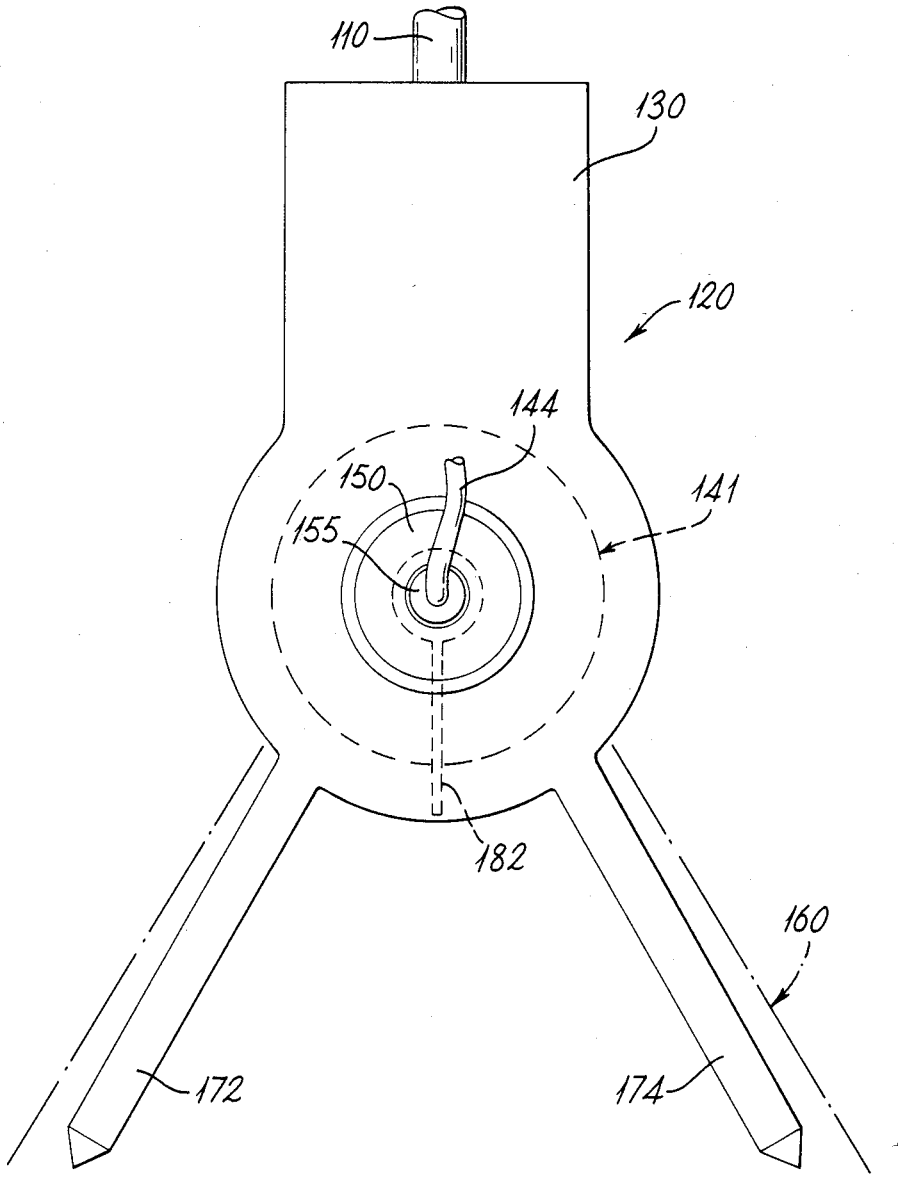

FIG. 5 is a part-sectional view of a further spray head according to the invention and FIG. 6 is a side view of the spray head in FIG. 5.

FIG. 1 shows a spray head 20 for attachment to a spray lance 10 terminated by a spray nozzle 11. Conveniently the head 20 can be attached by using nuts and the threaded end of the spray lance but if required a push-on or clip-on construction can be adopted as will be apparent to those skilled in the art. The spray lance can be one of those readily available for agricultural and horticultural use.

The spray head 20 includes a generally box-shaped hood of material described below 30. As shown only three sides of the box are used, leaving open back, front and base sides. A fourth surface is provided, 35, at an angle of about 45° to the top 36. Sides 32 and 33 are arranged to support electrode mountings 41, 42 for an electrode arrangement of opposed electrodes one of which is shown at 43. (The other opposed electrode, 48, is on mounting 41 and is not shown in the main view.) The electrode mountings are secured to hood 30 for example by nut 50 at mounting holes such as 34. Conductors such as 44 permit the application of electrostatic voltages to the electrodes such as 43 and 48. Conveniently electrode 48 is a metal plate held in head 47 and connector 44 is pushed through stem 49 to make contact. Details of the connection at the electrode and the other end of connector 44 are not shown as many types are available to suit a specific use.

Mountings 41, 42 are generally mushroom shaped and of insulating material such as a plastics material. The mountings also have a convoluted form to obstruct the formation of a liquid path. Thus, electrode 41 is shown in section in an auxiliary view of FIG. 1. The region at the junction of stem 45 and head 47 is cut away, 46, to increase the leakage path from the electrode to the hood and assist the shedding of liquid which could make this path more conductive. Conveniently the mounting is in two parts, head 47 and stem 49. The stem may also include re-entrants to assist in the shedding of liquid. Other electrode arrangements may be used if more suitable to a particular application. The number and form of the electrodes may be altered for example for a different spray shape.

Hood 30 is made of any suitable material such as metal or plastics. If a non-conductive liquid is to be sprayed then the hood should be conductive or have a conductive surface, preferably inside and out. If the liquid is conductive enough the hood can be of insulating material. Conveniently the hood has a trough or other collector 31 around the open edges, inside and outside, to collect liquid deposited on the hood, as described below, and convey it to a larger collector, not shown, to permit disposal, or even re-use. In a suitable apparatus suction could be applied to aid collection. Absorbent material could be used if appropriate.

Spray nozzle 11 is of any suitable form to produce a required spray pattern and droplet size. Lance 10, and the attachment of hood 30 to lance 10, should provide a conductive path so that hood 30 is earthed, or at least "earthy", as indicated by the earth connection 21 in the Figure. This does not necessarily represent an actual earth wire as if the spray liquid is sufficiently conductive then no separate earth, other than that at the source of liquid (not shown) at the remote end of lance 10 may be needed. Otherwise a suitable earth, e.g. through a conductive lance 10 or an auxiliary conductor, is needed. A wire may be trailed on the ground, if needed, to provide an adequate earth.

The action of the spray head embodying the invention is as follows. The electrodes are energised from a suitable high voltage source. For a typical hand-held sprayer of the "knapsack" type the hood is a few inches square (say up to 10 cms across for metric dimensions) and a voltage of about 3 KV at a current drain of a few microamperes is appropriate. Both electrodes are connected to the same pole of the supply in the present arrangement, the other pole of the supply being earthed or earthy.

Spray from the nozzle 11, supplied with liquid under pressure in a known manner, passes between the electrodes and the droplets of the liquid in the spray are charged. The spray is charged to a polarity opposite from that of the voltage on the electrodes by induction. A space-charge also arises in known manner. In the absence of the spray head hood some droplets from the spray would return to the electrode mountings and provide a conductive path short-circuiting the electrostatic supply. The presence of the internal, and especially the external, earthed hood surfaces (or these surfaces made earthy or earthed by a conductive liquid coating), together with the assistance of the space-charge, traps the return spray droplets and prevents, or at least reduces, the build-up of liquid on the electrode mountings. The spray trapped on the hood as a liquid can be allowed to drip away but conveniently the trapped liquid can be collected, e.g. by trough 31, and retained. A wick could be used if suitable.

Measurements have been made of the effectiveness of the spray head configuration using opposed electrodes in a nozzle hood, as described above. These show that the deposits of active ingredient achieved at recommended application rates of diluted chemical can be achieved at lower usage of chemical and diluent and high work rate, i.e. ground speed of the sprayer.

A suitable high voltage power unit is shown in FIG. 2. A battery B, conveniently of three 9 V PP9 layer-type dry cells, energises the unit. A semiconductor dc/dc converter HVC produces a dc supply nominally at 3 KV for a 12 volt input. The supply to the converter HVC is through a regulator REG which provides a stabilised 12 volt supply from the batteries as their voltage falls with use. The end of battery life is signalled by an alarm AL operated by a voltage comparator VC. Comparator VC is a differential amplifier having one input supplied by a zener reference diode Z and the other by the battery voltage through a potential divider. A suitable alarm level is 14 V.

There is some waste of power in the regulator REG but this is accepted to ensure stable spraying conditions and therefore a consistent application of material. A more efficient, but more complex, technique could be employed, for example based on a "chopper" regulator. The converter HVC in the present embodiment is a type 12GM 3000P from Alpha Repeater Limited.

FIG. 3 shows the result of a test using recommended application rates and dilution proportions for a spray representing a treatment of potato plants. The chemical to be applied was represented by an ultraviolet sensitive dye, as is well-known in the art. The recommended application rate is 1000 liters of diluent per hectare. A sample row of potato plants was sprayed by placing plants in a line and moving a spray head along in a conveyor in direction parallel to the line of plants. A spray nozzle producing 790 ml/minute moving at 0.25 m/s was used. This produces the required application rate for rows spaced at 0.5 m, each row being sprayed in turn. (The spray pressure was 3 bars to a TEEJET (R.T.M.) type 8002 nozzle made by Spraying Systems Limited.) As this test represents the recommended use of course no charge was applied.

The graph in FIG. 3 shows the probability of a site, e.g. a plant leaf or stem, receiving a certain deposit of chemical. The deposit, measured in microliters/square centimeter of leaf or stem, is the Y-axis and the percentage of sites is the X-axis. A sensible standard is that between 50% and 80% of the sites receive a minimum deposit. Thus the recommended application produces a deposit of between 0.4 and 0.2 microliters/square centimeter of leaf (front and back surfaces are measured in all cases). This, when based on 1.5 Kg of chemical in the 1000 liters of diluent per hectare, gives a chemical deposit of 1.5 microgram per microliter, i.e. 0.6 to 0.3 microgram per square centimeter of leaf or stem site.

FIG. 4 shows the results of two tests with the spray head according to the invention that is fitted with a hood. The spray nozzle was changed to a TEEJET (R.T.M.) type 800067, at the same pressure of 3 bars, to give a flow rate of 250 ml/minute. The nozzle was moved at 0.87 m/s. The combined result of these changes is a tenfold reduction in delivery, i.e. only 100 liter/hectare. FIG. 4 shows in curve "E" the deposit with charge applied by energising the electrodes and in curve "OP" the deposit without energising the electrodes so that the droplets are uncharged. From the graph 50% of the sites receive more than 0.19 microliters/square centimeters of deposit. To achieve the previous chemical level of 0.6 micrograms only 0.32 kilogram of chemical need be used for 100 liters of diluent. Clearly some of the saving is by no longer spraying to "run-off" but curve "O" shows that to achieve then the required level of chemical deposit more than twice the concentration of chemical is required, about 0.8 Kg per 100 liters. This also leads to considerable waste of chemical and a "coarser" application as each deposit has a higher concentration of chemical.

The overall result for the electrostatic spray using the hooded induction charged spray head is thus the production of the required chemical application for the cost of only one fifth of the chemical and one tenth of the diluent with a threefold (0.20 to 0.87 m/s) increase in work rate.

The overall improvement clearly depends on the nature of coverage required. For a non-mobile pest and a contact-acting pesticide a deposit rate of 80% rather than 50% is probably preferred. Here the charged spray is proportionately even better than the uncharged one.

The overall improvement arises from the use of smaller, induction charged drops with the further benefit when using a spray fan in the vertical plane that the field from the charging electrodes widens the fan, horizontally, by electrostatic action. Overall there is a better deposition of material with reduced overall consumption and smaller drops improving cover. It has been found that the spray is conveniently applied by an operator walking alongside a row of plants and directing the spray at right angles to the row from an elevation of about 45° with the hood surface 36 set on the lance to be approximately horizontal, although an inclination of up to 30° around the lance axis can be accepted before the spray wets the electrodes. A filter of 100 mesh is used with the 800067 nozzle.

A further spray head embodying the invention is shown in FIGS. 5 and 6. The spray head 120 is of the same general arrangement as that shown above, in that it is of hood form 130 for attachment to a spray lance 110 or other use in conjunction with a hydraulic nozzle, for example by being attached to a spray boom carrying such a nozzle.

Referring to FIG. 5 the hood 130 is of generally U-shape and made of conductive metal or a plastics material. If plastics material is used then a conductive metal coating may be needed unless the liquid to be sprayed is sufficiently conductive. The surface area of the hood 130 is reduced compared to that shown above in FIG. 1. This reduction reduces the amount of liquid collected. As seen best in FIG. 6 the hood is made to be larger than electrode mountings 141, 142. This has been found desirable to maintain an effective barrier against returning spray liquid. The electrode mountings, 141, 142 are similar to those in above being secured to hood sides 132, 133 by nuts and flanges such as 150, 149. An EHT supply lead 144 extends to electrode 148. The hood 130 extends around lance 110 and spray nozzle 111 so that in operation a spray 160 of liquid from nozzle 111 is charged by the electric field from electrodes such as 148 and 143 to earth when both are connected to one pole of the supply the other pole being connected directly or indirectly to nozzle 111 and usually being earthed for safety and convenience. The spray 160, in this embodiment, is of a fan-like shape, in the plane of the drawing of FIG. 6, defined by the hydraulic nozzle 111, but modified by the electric field if required.

The drawings show that both the hood, 130, and electrode mountings, 141, 142, are provided with projections. These projections are elongate, sharp-pointed members which produce an important advantage in that liquid flows over them to the points and is there formed into small droplets by electric field action. The hood projections are indicated at 171, 172, 173, 174 and the electrode mounting projections at 181, 182 (173 is not shown).

Each hood projection extends as a thin strip from the hood and ends in a sharp point, such 170, which curves in towards the position of spray 160. The projections 180, 181 are of sheet form and each similarly extends to a sharp point, which this time is directed towards the hood itself. The projections can be of similar material to the hood and electrode mountings respectively as similar electrical requirements apply. Conveniently the projections could be moulded or otherwise formed to be integral with the hood or electrode mounting. Alternatively the projections could be added on as required and secured in a suitable manner.

In operation of the spray head the spray from nozzle 111 is charged as described in above and liquid from the return spray is deposited on the hood. From here the return spray could drip off in large droplets as waste which could even cause damage to a crop by delivering an excessive amount of chemical at one point. It is also possible for some spray to land on the electrode mountings. To reduce the possibility of large droplets being allowed to fall the projections are arranged to allow liquid to flow towards the points. The liquid flow is controlled by the form of the projections where they abut the hood and mountings to channel the flow towards the points.

At the points at the end of the projections the liquid experiences a significant electric field. In the case of the hood projection the liquid is earthed or earthy and the space charge field on the charged spray is nearby to cause the liquid to leave the points such as 170 as small droplets. In the case of the electrode mounting projection the liquid is at a high potential to the earthy or earthed hood and the liquid is again caused to leave the points of the projections as small droplets. Although the small droplets are likely to be of a size commensurate with the larger particles in the spray from the nozzle they will be small enough to be considered part of the spray and significantly smaller than the drips from the spray head to waste. The hood is shown with an earth connection 121. As mentioned above, for FIG. 1, this earth connection can be an actual conductor or the liquid if conductive.

FIG. 5 also shows a convenient form of electrical connection of the EHT supply to the electrode such as 148. A plastics tube 151, for example of PVC, is inserted into the stem of the electrode mounting and arranged to project from the stem, as shown. Tube 151 contains a conductive rod. 152, for example of brass, which is in conductive contact with electrode 148 and projects from tube 151. The outer end of rod 152, at 154, is enlarged to form a plug to which a free EHT socket, 155, can be applied. An O-ring 153 is fitted in a groove on tube 151 to be engaged by the inside of the socket 155 to form a water-resistant connection so that leakage of EHT is prevented. This arrangement has been found to withstand being submerged while maintaining electrical integrity.

The general arrangements of the hood and projections has not been found to be critical and the number of form of projections can be varied although comb-like multiple-pointed projections do not seem to be very effective. It has been found that points such as 170 are more effective if beyond a minimum distance from nozzle 111. The minimum position is quite well-defined. In the illustrated embodiment it is about 50 mm from the nozzle and over a distance of about 5 mm the removal of liquid becomes effective, remaining effective for a further range of about 100 mm from this position. In general a few relatively long, well-defined projections or points on projections seem to be more effective than lots of small short points. This may be because the field is more intense with this arrangement. One or two projections or points appear to be adequate in many cases.

Although specifically described for a nozzle producing a fan-shaped spray clearly nozzles producing other shapes, e.g. a cone, may be used in which case appropriate changes to hood shape may be needed.

The arrangement described mitigates a problem arising when too much liquid accumulates on the hood and large drops of liquid form on the hood and electrodes by converting the drops into small droplets which can contribute to the spray. This avoids waste and possible crop damage, a double economy of material and treatment. The arrangement does not make the spray head much more complicated or expensive as the projections can be produced in the same moulding or shaping action as the hood.

An arrangement is known, e.g. UK PS No. 1538931, in which an induction charging adaptor for an air assisted paint sprayer is constructed with earthed shields specifically to push charged drops back into the spray by repelling them with an electric field between the charging electrode and the shield. This is opposite to the action described here which is to attract spray away from the electrodes. However the action of the shield described in UK Patent Specification 1538931 is not likely to be uniform and can have local variations so drops could still be driven onto the electrode from other regions. The present invention acts to first collect the stray spray and then dispose of it.

I claim:

1. A sprayhead for a spray nozzle to disperse agricultural chemical liquids as droplets including a hood to extend forward from the nozzle, an insulating mounting for an electrode arrangement energisable in operation to exert a charging field forward of the nozzle for inductive charging action on liquid sprayed from the nozzle, the insulating mounting being supported by said hood and having a portion projecting from the hood to carry said electrode arrangement spaced from the hood and said portion having a region to obstruct the formation of a liquid path from the electrode arrangement across the mounting to the hood and thence to earth, the hood being made earthy and conductive at least in operation and also providing a return spray liquid droplet receiving and flow supporting surface to impede the return of charged and uncharged liquid spray to the electrode arrangement and the mounting therefor by supporting flow of received liquid away from said electrode mounting.

2. A spray head according to claim 1 including means for ready attachment and release from a spray nozzle or support lance therefor.

3. A spray head according to claim 1 including means to retain return spray deposited thereon.

4. A spray head according to claim 3 including means to collect said return spray deposited thereon.

5. A spray head according to claim 1 in which the electrode arrangement is opposed electrodes forward of the nozzle.

6. A spray head according to claim 1 in which the electrode arrangement is arranged to alter the shape of the spray fan from the nozzle.

7. A spray head according to claim 1 having at least one elongate projection and a liquid flow control means to direct return spray liquid received on the spray head to a said elongate projection for flow along said projection, whereby in operation with an electric field at the spray head liquid leaves said projection as small droplets.

8. A spray head according to claim 7 in which the elongate projection is attached to or part of the hood.

9. A spray head according to claim 8 in which at least one hood projection extends towards the path of liquid sprayed from the nozzle to approach a region having, in operation, a space charge field.

10. A spray head according to claim 7 in which the elongate projection is attached to or part of an electrode mounting.

11. A spray head according to claim 7 in which said at least one each projection has at least one sharp point.

12. A spray head according to claim 1 in which the insulating electrode mounting region is convoluted to obstruct the formation of a liquid path to earth from the electrode.

* * * * *